US006273953B1

(12) United States Patent
Yeh et al.

(10) Patent No.: US 6,273,953 B1
(45) Date of Patent: Aug. 14, 2001

(54) PIPING SYSTEM FOR ETCH EQUIPMENT

(75) Inventors: Chia-Lin Yeh, Tainan; Chi-Shu Huang, Chungli; Ming-Yeng Wang, Taipei; Jia-Rurng Hwu, Tainan Hsien, all of (TW)

(73) Assignee: Mosel Vitelic, Inc., Hsinchu (TW)

( * ) Notice: Subject to any disclaimer, the term of this patent is extended or adjusted under 35 U.S.C. 154(b) by 0 days.

(21) Appl. No.: 09/400,179

(22) Filed: Sep. 21, 1999

(51) Int. Cl.[7] ..... C23F 1/00
(52) U.S. Cl. ..... 118/345
(58) Field of Search ..... 156/345; 118/715

(56) References Cited

U.S. PATENT DOCUMENTS 4,817,557 * 4/1989 Diem et al. ..... 118/719
5,904,757 * 5/1999 Hayashi et al. ..... 96/416

* cited by examiner

*Primary Examiner*—Richard Bueker

(57) ABSTRACT

The present invention discloses a piping system for etch equipment including an exhaust gas tube connected with an etching chamber for conveying exhaust gas out of the chamber. A cooling gas tube connected to the etching chamber allows cooling gas to flow around a back side of the wafer placed in the chamber for cooling the wafer's temperature. A cooling gas bypass tube connected between the cooling gas tube and the exhaust gas tube is used for regulating a gas flow in the cooling gas tube. Moreover, a plurality of heaters are set out of conjunctions of the cooling gas tube and cooling gas bypass tube with the exhaust gas tube so as to retard particle accumulation in the conjunctions of these tubes.

19 Claims, 2 Drawing Sheets

PIPING SYSTEM FOR ETCH EQUIPMENT

FIELD OF THE INVENTION

The present invention relates to etch equipment for semiconductor manufacturing, and more specifically, to a piping system for etch equipment.

BACKGROUND OF THE INVENTION

The etching process is an important unit process to the semiconductor manufacturing and could be classified into wet etching process and dry etching process. The traditional dry etching processes mainly proceeds by introducing and sputtering ions onto a surface of a wafer placed in an etching chamber. Another etching process is to introduce plasma to ionize gaseous reactant into reactive ions, and the reactive ions react with the surface of the wafer thus forming volatile products, which are then pumped out of the chamber, thereby achieving the etching process. The etching process is well known as a Reactive Ion Etching method to the person having ordinary skill in the art.

The Reactive Ion Etching method is widely used in metal etching processes, such as aluminum, tungsten, and other alloys, for its high selectivity and anisotropism. Typically, in the Reactive Ion Etching process, chlorides or fluorides are introduced into the etching chamber for reacting with surface films patterned by photoresist layers of the wafer to form gaseous products. Thereafter, the gaseous products are pumping out of the etching equipment through a piping system by a pump.

For economizing the space of etching equipment, the piping system is usually designed winding around the bottom regions of the etching chamber, and moreover, for various usages, tubes and pipes of the piping system would have different diameters and complicated conjunctions. Therefore, particles generated from the products of the etching process would easily accumulate on inner walls of the conjunctions of the tubes and pipes of the piping system, especially in the tiny ones. For instance, a cooling tube connected to a chuck, which supports a wafer in an etching chamber, is used to introduce cooling gas flowing through the back side of the wafer to decrease the temperature raise due to sputtering while an etching process is performed. For regulating the flow of cooling gas in the cooling tube, a cooling gas bypass tube is connected between the cooling tube and an exhaust gas tube, which is connected to the chamber for conveying exhaust gas out of it. Since the diameter of the cooling gas bypass tube is smaller than that of exhaust gas tube, the particles generated from the chamber would easily accumulate on the inner wall of the conjunction of cooling gas bypass tube and the exhaust gas tube. When the particles accumulated in the cooling gas bypass tube, the cooling gas supply could be affected thereby causing the profile of the surface of wafer to be inaccurate.

Because the tubes and pipes are encased in the etch equipment, they can only be maintained or repaired after the use of the etch equipment is stopped. Therefore, the piping system is not only easily blocked by particles, but is also hard to maintain. Thus, novel designs are needed to provide a piping system that is easy to maintain thereby improving the performance of etch equipment.

SUMMARY OF THE INVENTION

An object of the invention is to provide a piping system for etch equipment.

Another object of the invention is to provide a piping system for etch equipment to prevent particles from accumulating in the piping system.

The present invention discloses a piping system for etch equipment including an exhaust gas tube connected with an etching chamber. The exhaust gas tube connects to a pump for conveying exhaust gas out of the chamber. A cooling gas tube connected with the chamber allowing cooling gas flowing around a back side of wafer placed in the chamber. A cooling gas bypass tube connects the cooling gas tube and the exhaust gas tube for regulating a gas flow in the cooling gas tube. In addition, a ballast gas tube connects with the exhaust gas tube for adjusting pressures and densities of the pump. Finally, a plurality of heaters are set out of conjunctions of the cooling gas tube and the cooling gas bypass tube with the exhaust gas tube so as to retard particle accumulation in the conjunctions of these tubes.

DETAILED DESCRIPTION OF THE PREFERRED EMBODIMENT

The present invention discloses a piping system for retarding particles accumulating in tubes of the system so as to improve the performance of etch equipment. For illustrating the present invention clearly, an embodiment is described as follows.

Figure 1:
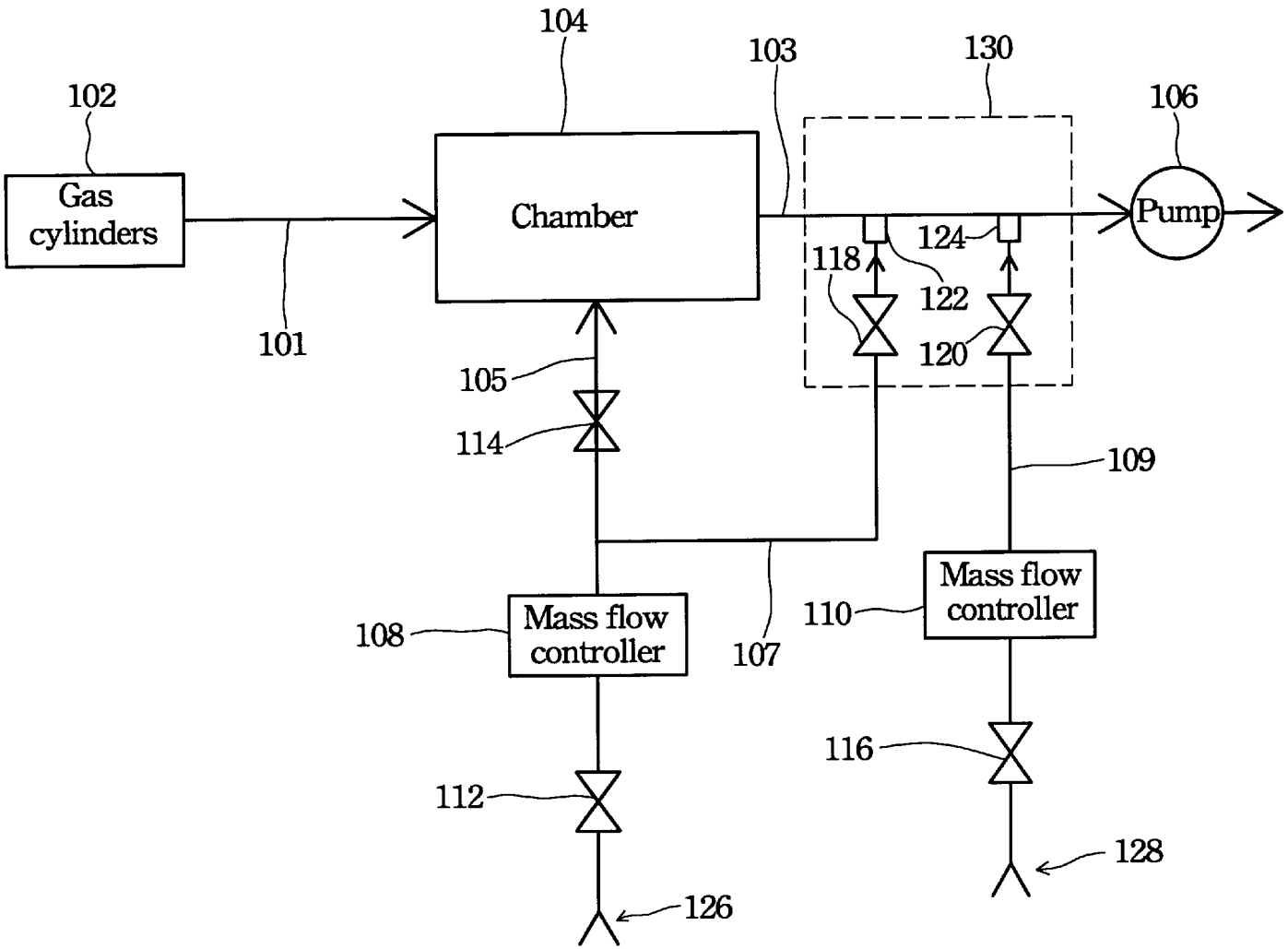
FIG. 1 is a functional block diagram of a piping system according to the present invention.

Referring to FIG. 1, a functional block diagram in accordance with an etcher of a type P5000, which could be obtained from Applied Materials Inc., Taiwan, is shown. The reactant gases stored in gas cylinders 102 are conveyed through an input tube 101 into an etching chamber 104, and then ionized into reactive ions by plasma induced in the etching chamber 104. Patterned surface layers of a wafer placed in the etching chamber 104 are then etched into volatile products by reacting with the reactive ions, and the volatile products are then pumped out through an exhaust gas tube 103 by a pump 106. In this preferred embodiment, the reactant gases are typically selected but not limited among $SiCl_4$, $BCl_3$, $BBr_3$, $CCl_4$, $CF_4$, $NF_3$, and $SF_6$ in most metal etching processes.

When the etching process is performed in the chamber 104, the temperature of the wafer placed in the chamber 104 would be increased due to the reactive ions sputtering on the wafer's surface. For lowering the temperature, a cooling gas is introduced through a cooling gas tube 105 into the chamber 104 to circle around grooves of a chuck, which supports the back side of the wafer. Since the cooling gas flows around the back side of wafer, the temperature of the wafer could be controlled in a desired range thereby stabilizing the etching process. In this preferred embodiment, a cooling gas, such as helium, is introduced from a cooling gas source 126 through a gate valve 122, mass flow controller 108, and gate valve 114 into the etching chamber 104. The mass flow controller 108 is used for adjusting and controlling the flow of cooling gas, and as to the gate valves 112, 114 could be selected between manual valves and air actuated valves according to practical demands. In addition, a cooling gas bypass tube 105 is connected between the cooling gas tube 105 and the exhaust gas tube 103 for regulating the flow of cooling gas in the cooling gas tube 105.

Furthermore, a ballast gas tube 109 is connected to the exhaust gas tube between the etching chamber 104 and the pump 106. A ballast gas, such as nitrogen, flows through the ballast gas tube 109 into the exhaust gas tube 130 to adjust the gas pressure and density in the pump 106 for preventing it from exploding or generating moisture to degrade its performance. In this preferred embodiment, the ballast gas is introduced from a ballast gas source 128 through a gate valve 116, mass flow controller 110, and gate valve 120 into the exhaust gas tube 103 to maintain the pump 106 in a preferable pressure. Similarly, the gate valves 116, 120 could be selected from manual valves and air actuated vales according to practical demands.

Typically, the diameters of the cooling gas tube 105 and cooling gas bypass tube 107 are about 6.37 mm, and the diameter of the exhaust gas tube 103 is abut 38.5 mm. Since the diameters of cooling gas bypass tube 107 and ballast gas tube 109 are connected with the exhaust gas tube 103, the particles of exhaust gas generated form the etching chamber would easily flow into conjunctions among these tubes. Moreover, because the diameters of both the cooling gas bypass tube 107 and ballast gas tube 109 are smaller than that of the exhaust gas tube 103, the particles would easily accumulate on inner walls of the cooling bypass tube 107 and ballast gas tube 109 to block the gas flows. For retarding the particle accumulation, heaters 122, 124 are placed out of the conjunctions of the cooling gas bypass tube 107 and ballast gas tube 109 with the exhaust gas tube 103 to increase the temperatures around there. Therefore, the particles would be prevented from accumulating in the conjunctions due to the temperature raise. For clarifying the structure of the heaters 122, 124 and these tubes, a region 130 is detailed in the following paragraphs.

Figure 2:
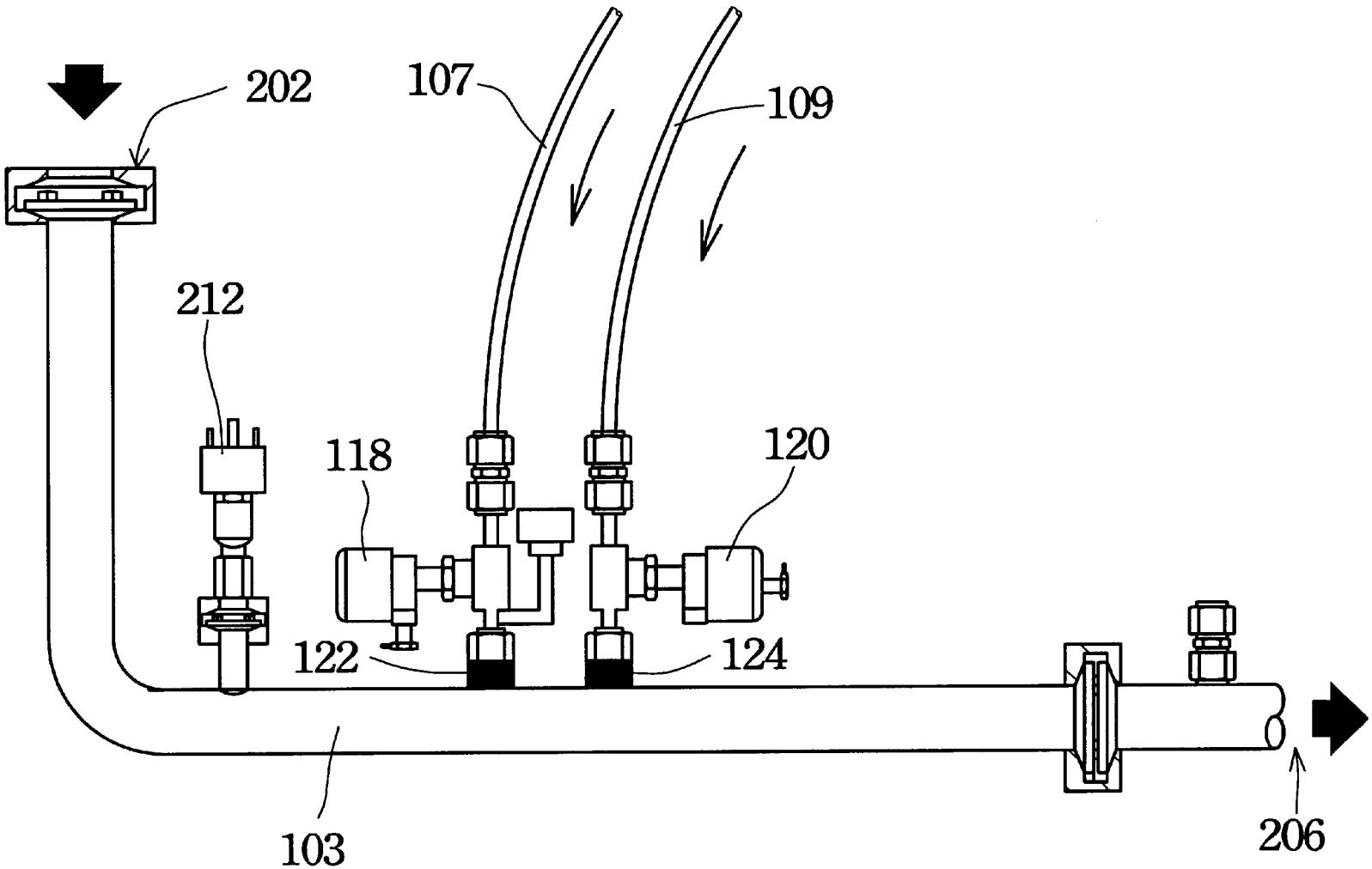
FIG. 2 is a local cross-sectional side view of the piping system according to the present invention.

Referring to FIG. 2, the exhaust gas tube 103 has an inlet 202 and outlet 206 connected to the etching chamber and pump. In this preferred embodiment, a thermal gauge is optionally coupled with the exhaust gas tube 103 for monitoring the gas flow in the tube. The cooling gas bypass tube 107 and ballast gas tube are connected through the gate valve 118 and gate valve 120. The conjunctions of the cooling gas bypass tube 107 and ballast gas tube with the exhaust gas tube 103 are heated in temperatures between about 80~90° C. by the heaters 122, 124 to effectively retard the particle accumulation. The heaters 122, 124 could be any type of radiation, convection, and conduction. In this preferred embodiment, the heaters are heat tapes, which consist of asbestos tapes containing thermal couples, wrapping around the cooling gas by pass tube 107 and ballast gas tube 109. When electricity flows through the thermal couples, the heat tapes could provide the capability of heating the tubes, thereby retarding the particles accumulating in them.

As is understood by a person skilled in the art, the foregoing preferred embodiments of the present invention are illustrative of the present invention rather than limiting of the present invention. They are intended to cover various modifications and similar arrangements included within the spirit and scope of the appended claims, the scope of which should be accorded the broadest interpretation so as to encompass all such modifications and similar structures.

What is claimed is:

1. A piping system for etch equipment, the system comprising:

a chamber for performing an etch process for a wafer;

an exhaust gas tube connecting with the chamber for conveying exhaust gas out of the chamber;

a cooling gas tube connecting to the chamber for conveying cooling gas flowing through a back side of the wafer thereby decreasing the wafer's temperature;

a cooling gas bypass tube connecting between the cooling gas tube and the exhaust gas tube for regulating a flow of cooling gas in the cooling gas tube; and a heater located on a joint region between the cooling gas bypass tube and the exhaust gas tube for heating the joint region thereby preventing particles accumulating in the joint region.

2. The piping system of claim 1, further comprising a mass flow controller coupling with the cooling gas tube for adjusting flow rates of the cooling gas in the cooling gas tube.

3. The piping system of claim 1, further comprising a gate valve coupling between the cooling gas tube and the chamber for switching the cooling gas tube between on and off.

4. The piping system of claim 1, further comprising a gate valve coupling between the cooling gas bypass tube and the exhaust gas tube for switching the cooling gas bypass tube between on and off.

5. The piping system of claim 1, further comprising a pump connecting with the exhaust gas tube for pumping the exhaust gas out of the chamber.

6. The piping system of claim 5, further comprising a ballast tube connecting between the chamber and the pump for providing the pump ballast gas to adjust gas pressure and density in the pump.

7. The piping system of claim 6, further comprising a mass flow controller connecting with the ballast tube for controlling a flow of the ballast gas.

8. The piping system of claim 7, wherein the ballast gas comprises nitrogen gas.

9. The piping system of claim 1, wherein the cooling gas bypass tube has a diameter about 6.37 mm.

10. The piping system of claim 1, wherein the heater comprises a heat tape.

11. The piping system of claim 1, wherein the cooling gas comprises helium gas.

12. A piping system for etch equipment, the system comprising:

a chamber for performing an etch process for a wafer;

an exhaust gas tube connecting with the chamber for conveying exhaust gas out of the chamber;

a pump connecting to the exhaust gas tube for pumping the exhaust gas out of the chamber through the exhaust gas tube;

a cooling gas tube connecting to the chamber for conveying cooling gas flowing through a back side of the wafer thereby decreasing the wafer's temperature;

a cooling gas bypass tube connecting between the cooling gas tube and the exhaust gas tube for regulating a flow of cooling gas in the cooling gas tube;

a ballast gas tube connected to an exhaust line at a point between the chamber and the pump for providing the pump ballast gas to adjust gas pressure and density in the pump; and heaters located on a joint region between the cooling gas bypass tube and the exhaust gas tube for heating the joint region thereby preventing particles accumulating in the joint region.

13. The piping system of claim 12, further comprising a mass flow controller coupling with the cooling gas tube for adjusting flow rates of the cooling gas in the cooling gas tube.

14. The piping system of claim 12, further comprising a gate valve coupling between the cooling gas tube and the chamber for switching the cooling gas tube between on and off.

15. The piping system of claim 12, further comprising a gate valve coupling between the cooling gas bypass tube and the exhaust gas tube for switching the cooling gas bypass tube between on and off.

16. The piping system of claim 12, wherein the cooling gas bypass tube has a diameter between about 6.37 mm.

17. The piping system of claim 12, wherein the heater comprises a heat tape.

18. The piping system of claim 12, wherein the cooling gas comprises helium gas.

19. The piping system of claim 12, wherein the ballast gas comprises nitrogen gas.

* * * * *